United States Patent [19]

Freze

[11] Patent Number: 4,507,080

[45] Date of Patent: Mar. 26, 1985

[54] LAUNDRY DRYER

[75] Inventor: Benjamin H. Freze, Garden Grove, Calif.

[73] Assignee: Challenge Cook Bros., Inc., Industry, Calif.

[21] Appl. No.: 516,308

[22] Filed: Jul. 22, 1983

[51] Int. Cl.[3] ..... F27B 7/36; F27B 7/00; F26B 21/06; F26B 19/00

[52] U.S. Cl. ..... 432/105; 34/82; 34/85; 34/133; 432/103

[58] Field of Search ..... 432/103, 105; 34/133, 34/82, 85

[56] References Cited

U.S. PATENT DOCUMENTS

| | | | |
|---|---|---|---|
| 2,503,448 | 4/1950 | Morris | 432/105 |
| 2,712,182 | 7/1955 | Vetorino | 34/82 |
| 2,809,025 | 10/1957 | Pettyjohn | 432/105 |
| 3,601,903 | 8/1971 | Freze | 34/133 |
| 3,815,257 | 6/1974 | Freze | 34/133 |
| 3,866,335 | 2/1975 | Neville | 34/133 |
| 3,995,988 | 12/1976 | Freze | 432/105 |
| 4,065,253 | 12/1977 | Bullock | 432/105 |
| 4,334,366 | 6/1982 | Lockwood | 432/105 |

*Primary Examiner*—John J. Camby
*Attorney, Agent, or Firm*—Lyon & Lyon

[57] ABSTRACT

A commercial laundry dryer with a perforated drum for the laundry mounted in a housing to rotate on a horizontal axis and the drum is of the full width and length of the housing to maximize the load size for the floor space occupied by the housing. The fuel-fired burner is mounted below the drum and faces upward with a deflector preventing the flame from contacting the drum. The fan for circulating the drying air is mounted above the drum as are dampers for selectively causing the drying air to be recirculated to the burner and drum or exhausted after a single pass and a lint collecting and discharging arrangement. The drying air is introduced into the bottom of the drum at the center, passes upwardly through the laundry load and out through the top of the drum near the axial ends.

24 Claims, 18 Drawing Figures

FIG. 8.
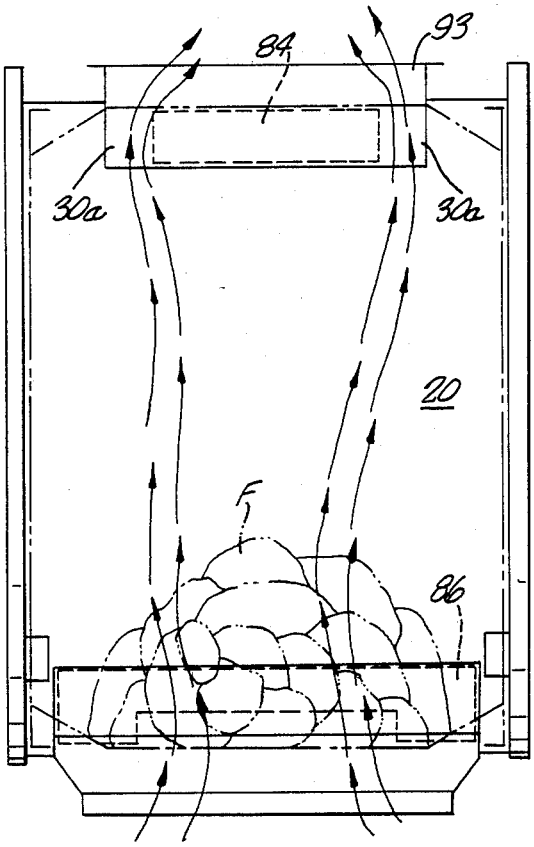
FIG. 9.
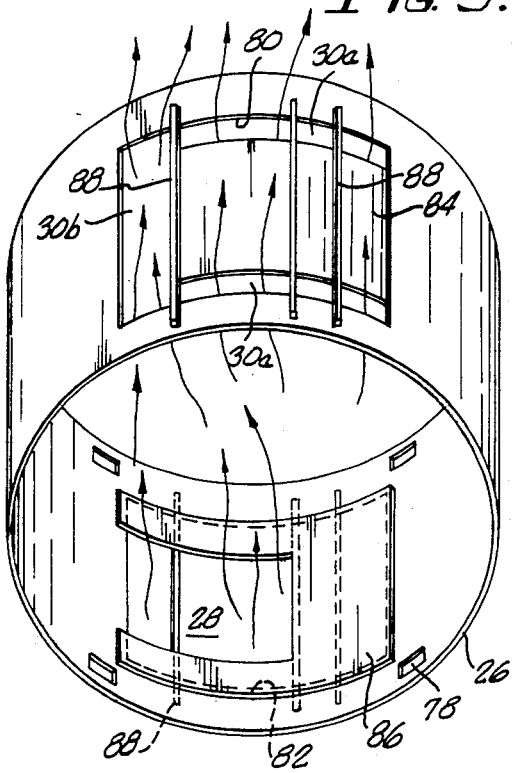
FIG. 10.
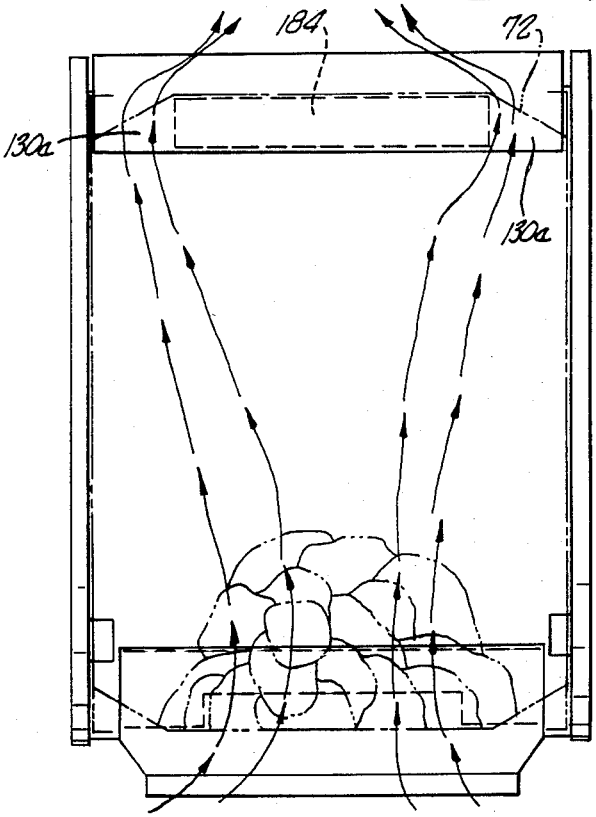
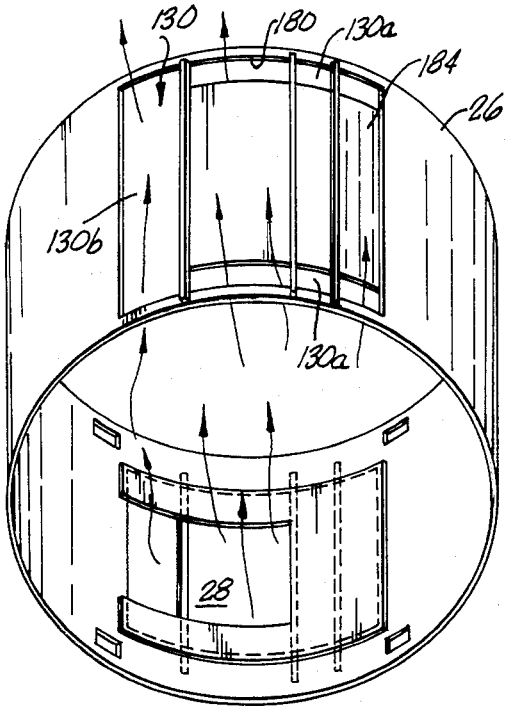
FIG. 11.

FIG. 14.
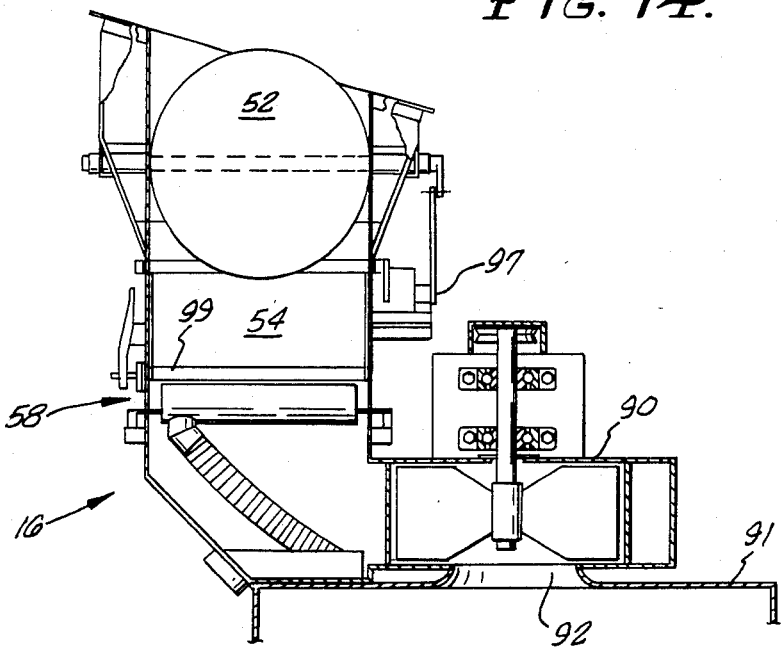
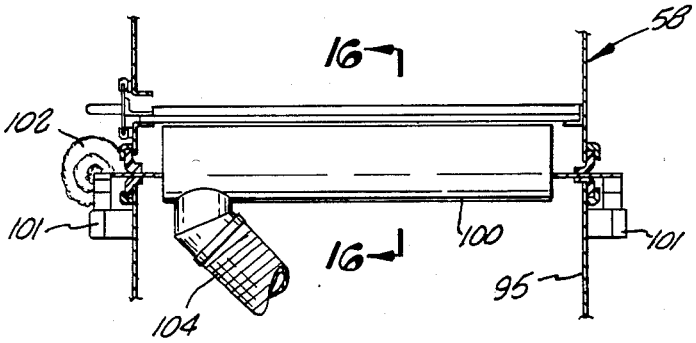
FIG. 15.
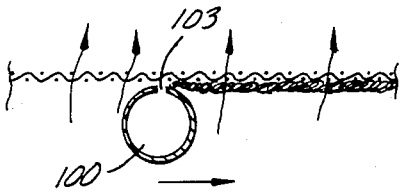
FIG. 16.
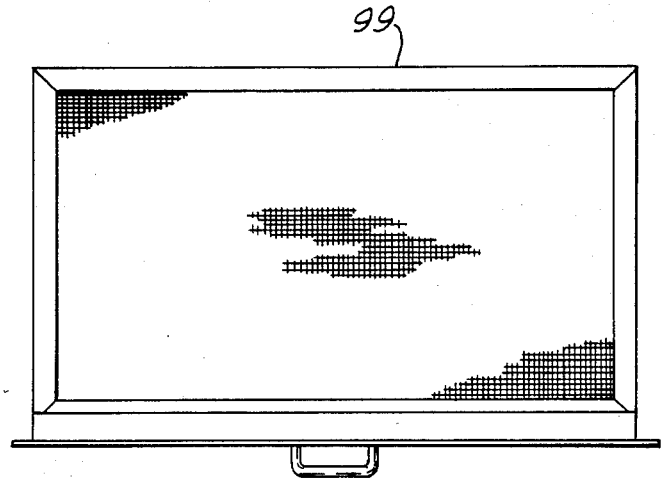
FIG. 17.

LAUNDRY DRYER

This invention relates to commercial fabric dryers and although it will have other applications it is particularly directed to commercial laundry dryers that are used in automated or semiautomated installations where a multiplicity of dryers are positioned side by side and a conveyor supplies the wet laundry to the dryers from one or more washing machines.

It is becoming increasingly more common in the commercial and industrial laundry industry to employ automatic of semiautomatic machinery and systems whereby the soiled fabrics are introduced continuously or in batches into washing machines and thereafter the fabric is processed through the steps of washing, rinsing, water extraction, and drying through different machines or compartments in machines and conveyors between the machines without requiring manual loading or unloading. An operator may control the cycles of the machines and the transfer of fabrics from one machine to another or those controls may be completely automatic through the use of timers, temperature sensors, moisture sensors, etc. A typical installation may use a single continuous batch washer for washing and rinsing the fabrics and a single water extractor for removing the excess water from the fabrics but several dryers are required to handle the rate of production of the washer and extractor. Typically the dryers are arranged side by side in a row and a shuttle conveyor mechanism transports the wet laundry from the water extractor to each of the dryers. Most conventional dryers are of the tumbler type having a cylindrical drum adapted to rotate on a horizontal axis and heretofore the burners, air circulating ducting, controls and the like have been physically positioned along side the rotating drum. However, with the current systems using a mutliplicity of dryers positioned in a row to be supplied by a conveyor, the prior conventional tumbler dryer constructions occupy an excessive amount of floor space to the tumbler drum capacity due to the normal location of the components and the need for access for maintenance thereby creating excessively long rows.

It is a principle object of this invention to provide a tumbler dryer construction in which the components are arranged above and below the tumbler drum to minimize the floor space occupied for a given drum size and to arrange those components in a manner permitting maintenance to be performed from only the front and back whereby the spacing between adjacent dryers may be minimized.

Another object of this invention is to provide a tumbler dryer in which the burner is located below the tumbling drum to supply heated air upwardly through the drum in a unique manner for highly efficient fabric drying. A still further object is to provide such a tumbler dryer in which the supply air for the burner is conducted from above the tumbler dryer along the sides thereof downwardly to the burner for preheating the air and minimizing the loss of heat to the outside.

Still another object of this invention is to provide a tumbler dryer with appropriate ducting and dampers above the tumbler drum for selectively supplying fresh air to recirculating the air to the burner in a unique heat-conserving manner. A further object of this invention is to provide such an arrangement wherein a lint removal apparatus is positioned within such ducting and damper arrangement in a manner for extracting lint from the drying air leaving the tumbler in either single pass or recirculation operation. A still further object of this invention is to provide such a lint removal apparatus wherein a screen positioned in the air flow collects the lint and a vacuum manifold periodically moves across the screen to remove and dispose of the lint.

A still further object of this invention is to provide a unique burner arrangement for a tumbler dryer in which the flame of the burner is directed upwardly toward the tumbler drum with a flame-deflecting dome interposed between the burner and the drum to deflect the flame outwardly and downwardly into the circulating air supply for heating the air that is then passed upwardly through the tumbler drum.

Still another object of this invention is to provide a tumbler dryer construction wherein the rotating drum is supported at its extreme ends and is surrounded by a closely spaced cylindrical shell with openings therein only at the desired locations for accomplishing the drying air circulation through the drum wherein the close spacing between the drum and shell virtually prevents any significant bypass of heated air around rather than through the drum without the need for the heretofore conventional flexible seals.

Other and more detailed objects and advantages of this invention will be apparent to those skilled in the art from the following description of the preferred embodiment of this invention and the accompanying drawings.

FIG. 8 is a diagrammatic side view of the tumbler drum and air inlet and outlet openings thereto for illustrating the air flow path.

FIG. 9 is a diagrammatic perspective view of the cylindrical shell surrounding the tumbler drum of FIG. 8 and further illustrating the air flow paths.

FIG. 10 is a diagrammatic side elevation of the tumbler drums and air openings similar to FIG. 8 but illustrating an alternate form in which the air outlet openings are spaced a greater amount.

FIG. 11 is a diagrammatic perspective view similar to FIG. 9 but illustrating the alternate embodiment of FIG. 10.

FIG. 14 is a sectional side view similar to FIG. 13 taken substantially on line 14—14 in FIG. 12.

FIG. 15 is an enlarged, partial sectional view similar to FIG. 14 illustrating the lint removal arrangement.

FIG. 16 is a partial sectional view taken substantially on the line 16—16 of FIG. 15.

FIG. 17 is a plan view of the lint removal screen employed in the tumbler dryer of this invention.

Figure 1:
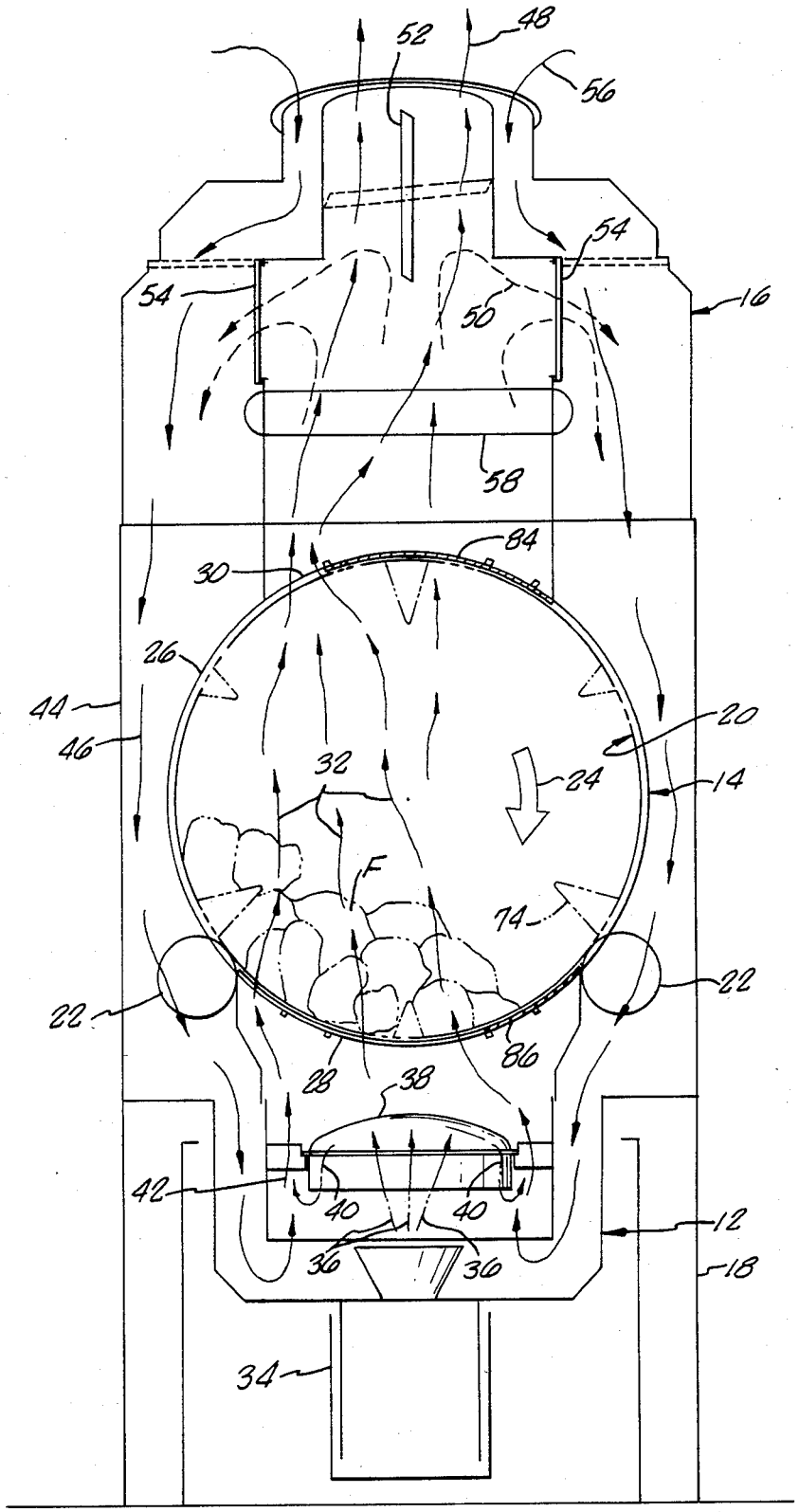
FIG. 1 is a diagrammatic front elevation view of the tumbler dryer of this invention illustrating the unique air flow path accomplished by this invention.

Referring now more particularly to FIG. 1, the tumbler dryer machine, generally designated 10, is comprised of three basic sections, the heater section 12, the tumbler section 14, and the air handling section 16, all supported on a base frame 18. The details of construction of the individual sections will be described more fully hereinafter but the general operation of the tumbler dryer machine 10 will be described here as an introduction and overview of the operation and utility of the tumbler dryer machine of this invention. The tumbler section 14 includes a perforated drum, generally designated 20, rotatably supported on four rollers 22 to rotate in the direction of arrow 24 (clockwise in FIG. 1) to tumble the load of laundry fabric F in a conventional manner. A cylindrical shell 26 surrounds the tumbler drum 20 to confine the drying air to the drum and has an inlet opening 28 in the bottom and an outlet opening 30 in the top for causing the drying air to pass through the drum in the manner illustrated by arrows 32.

The drying air is supplied to the tumbler section 14 from the heater section 12 which is provided with a burner 34 that may be of any type but it is preferred to use the burner of U.S. Pat. No. 4,128,388. Burner 34 is oriented to direct its flame upwardly toward the tumbler section as shown by arrows 36 with the flame being deflected by the dome shaped heat shield 38 to direct the products of combustion outwardly and downwardly as shown by arrows 40 to combine with the drying air and then flow upwardly around the outside of the shield 38 as shown by arrows 42 into the tumbler drum. Although for some aspects of this invention it would be adequate to provide the supply of drying air to the heater section 12 merely from the atmosphere surrounding that section, it is preferred that the drying air be supplied from the air handing section 16 downwardly along the sides of the tumbler section 14 between the shell 26 and the housing wall 44 as shown by arrows 46 whereby the drying air is preheated before reaching the heater section 12 and any leakage of hot air from the tumbler section 14 merely combines with the supply of drying air.

The air handling section 16 includes an exhaust fan (not shown in FIG. 1) for drawing air from the tumber section 14 through the opening 30 in shell 26 and either discharging that air to atmosphere as shown by arrows 48 or recirculating that air as shown by dashed arrows 50, depending on the position of exhaust damper 52 and the two inlet dampers 54. The dampers 52 and 54 are shown in solid lines in FIG. 1 in their respective positions for the open loop drying mode with fresh air from the atmosphere being drawn in through the annular opening in the top as shown by arrows 56 and exhausted from the machine as shown by arrows 48 after a single path of the air through the tumbler dryer. Dampers 52 and 54 are shown in dashed lines for operation of the tumbler dryer machine in a recycling mode wherein the air drawn from the tumbler section 14 is redirected downwardly passed the tumblers as shown by arrows 46 to be reheated by the burner 34 and reintroduced into the bottom of the tumbler through opening 28 which may be advantageous for fuel saving, fabric conditioning and other purposes, as well known to those skilled in the art. A lint removal apparatus 58 is provided in the air handling section 16 immediately upstream of the location of the dampers 52 and 54 whereby the air from the tumbler is filtered to remove the lint in either the open loop mode or recycling mode of operation. The details of the operation of the lint removal apparatus 58, as well as the other components mentioned above will be described in greater detail below.

Figure 2:
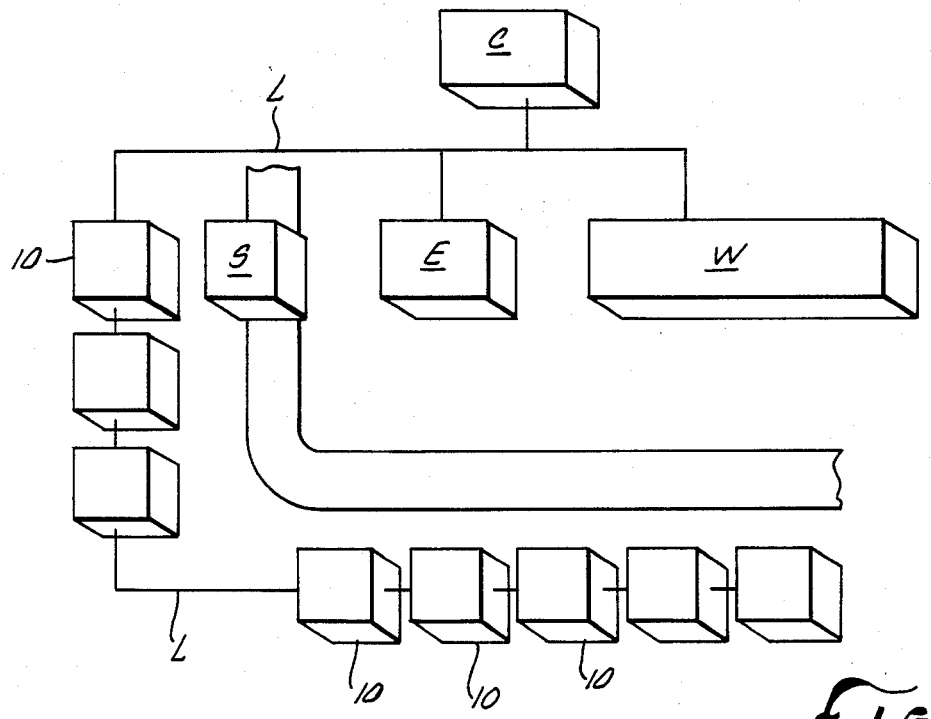
FIG. 2 is a schematic plan view of a typical commercial laundry installation employing the dryer of this invention.

It is to be noted from the diagrammatic illustration of FIG. 1 that the heater section 12 is entirely below and the air handling section 16 is entirely above the tumbler section 14 whereby the overall width and depth of the tumbler dryer machine 10 is minimized for the size and capacity of tumbler drum 20 of the machine with only a small space on each side of the tumbler shell 26 and the housing 44 for the passage of drying air. Further, the sides of the machine 10 may be fixed with only the front, back, top and bottom openable for maintenance of the various components. This is extremely advantageous in dryer installations employing a multiplicity of dryers supplied by a conveyor system as shown in FIGS. 2 through 5. In the illustrative plan view of FIG. 2, the dryers 10 may be arranged in one or more rows in side by side relationship to be supplied with wet laundry by a shuttle conveyor S from a water extractor E which is in turn supplied with wet, clean laundry from a continuous batch washer W, all of which may be controlled from the computer control station C through control lines L. This type of arrangement of the different machines in a commercial laundry has become relatively conventional although, insofar as applicant is aware, it has not been possible previously to control the operations of all of the machines from a single computer control since the dryers did not include appropriate micro processor controls with the required sensors and timers prior to the development of applicants tumbler dryer machine 10. The illustration in FIG. 2 is diagrammatic but reference to FIGS. 4 and 5 more accurately represent the manner in which the tumbler dryers 10 may be closely spaced side by side in an installation. For example, but not by way of limitation, a tumbler dryer machine 10 having a capacity of 100 kilograms (220 lbs.) will have a width of 80 inches and yet the space "D" between adjacent machines may be conveniently 2 to 4 inches since no access to the side of the machine is required.

Figure 3:
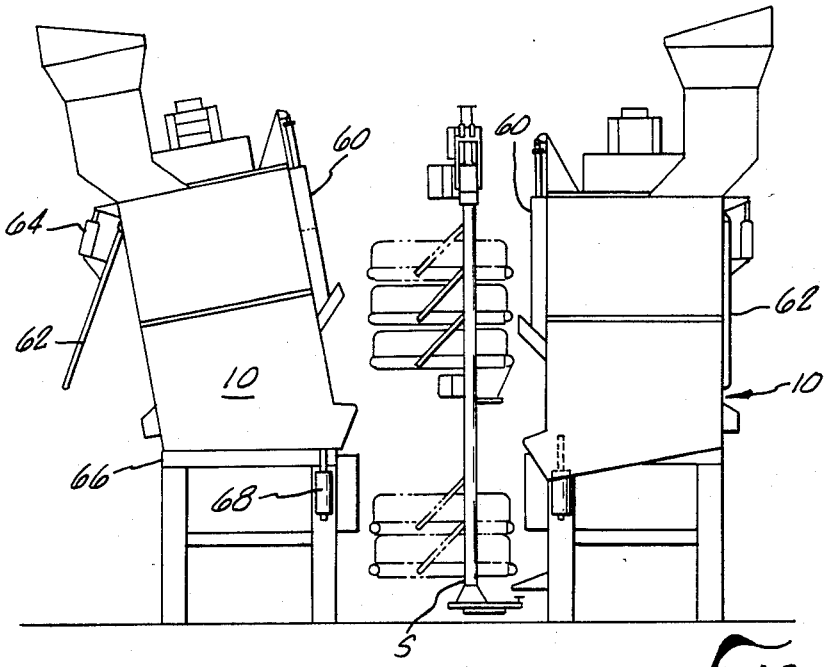
FIG. 3 is a side elevation view of another typical installation using two rows of facing tumbler dryers of the type of this invention being supplied with wet laundry from a shuttle conveyor positioned therebetween.
Figure 4:
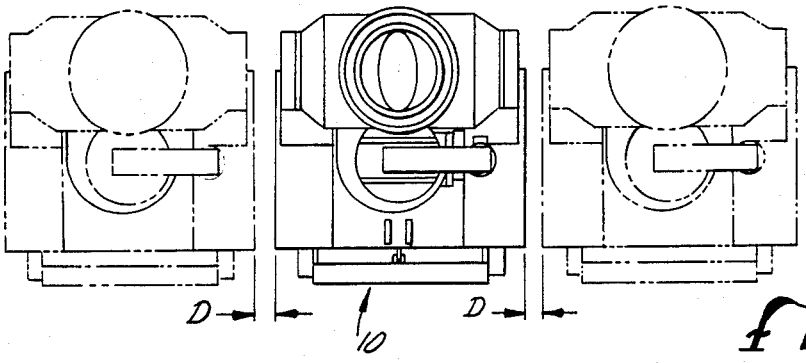
FIG. 4 is a plan view of a tumbler dryers of this invention installed side by side.
Figure 5:
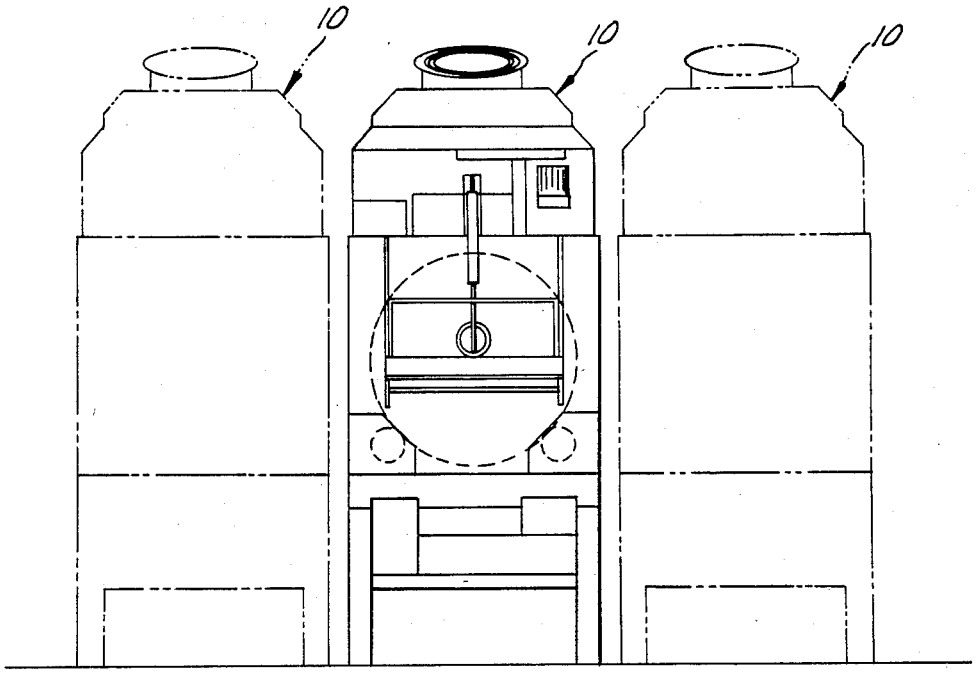
FIG. 5 is a front elevation view similar to FIG. 4.

Referring to FIG. 3, there is illustrated an arrangement using two rows of dryers 10 facing the shuttle conveyor S positioned therebetween. A loading door 60 is provided on the front of each machine and adapted to be opened vertically for introducing the wet fabric F. An unloading door 62 is provided on the rear of each dryer and is adapted to be pivoted open by an actuator 64 as shown on the left hand dryer 10. Further, the entire dryer is adapted to be tilted about a pivotal mounting 66 by an actuator 68 to assist in unloading the dried fabric. It is to be noted that the opening of the doors 60 and 62 and the tilting of the dryer does not require lateral spacing between dryers whereby the small dimension "D" may be maintained.

Figure 6:
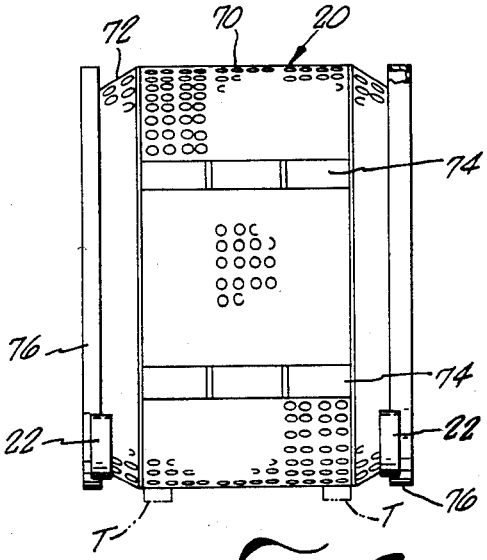
FIG. 6 is a side elevation view of the perforated tumbler drum construction of this invention.

Referring now to FIG. 6, the perforated tumbler drum 20 is shown in greater detail and includes a central cylindrical portion 70 with tapered end portions 72 for preventing the fabric from accumulating in the ends of the drum. Lifting ribs 74 are provided on the inside of the drum and may be of different sizes as shown in FIG. 1 for causing the desired tumbling action of the fabric.

Figure 7:
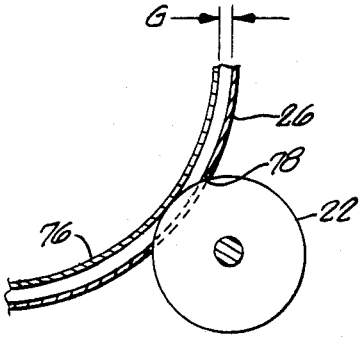
FIG. 7 is an enlarged end view of a portion of the tumbler drum of this invention and its roller support.

A circular track 76 is mounted on each extreme end of the drum at the tapered portion and has the same diameter as the cylindrical portion 70 of the drum. The tracks 76 engage the rollers 22 for supporting the drum for rotation. The cylindrical shell 26 has an inside diameter only slightly larger than the outside diameter of drum cylindrical portion 70 and track 76 to leave only a small annular space or gap "G" therebetween as shown in FIG. 7. For a typical tumbler drum of perhaps a 68 inch diameter, the space "G" is preferably one-half inch or less. An opening 78 is provided in the cylindrical shell 26 at the location of each roller 22 for the roller to extend therethrough for engaging the drum track 76. By providing only a small space "G" between the major portion 70 of the perforated drum 20 and the surrounding shell 26, the quantity of drying air that is allowed to bypass the interior of the drum 20 for drying the fabric is minimized. In contrast, in prior art tumbler dryers a pair of tracks "T" were provided on the cylindrical portion of the drum, as shown in phantom lines in FIG. 6, which, due to the thickness of the tracks required for structural strength, resulted fn a large gap between the drum and the surrounding shell thereby requiring the use of flexible seals to inhibit the bypass of drying air around the exterior of the drum. However, such seals are subjected to substantial wear as a result of the severe operating conditions and soon become ineffective. The small amount of bypass drying air allowed by the construction disclosed herein eliminates the need of any such flexible seals.

Referring to FIGS. 8 and 9, the path of air circulation through the tumbler section 14 is illustrated in greater detail. The cylindrical shell 26 may have the air openings top and bottom cut from the original cylindrical shape to precisely the desired opening size and shape or, as shown in the drawings, oversized top and bottom openings 80 and 82, respectively, in a rectangular shape may be cut from the shell and restrictor plates 84 and 86 of the desired shape may be mounted on the inside of the shell over the top and bottom openings, respectively. A plurality of bars 88 may extend axially across the openings 80 and 82 for supporting the plates 84 and 86. With the somewhat "U" shaped bottom plate 86 in position, the inlet opening 28 is of a rectangular shape centered in the axial direction but off-center circumferentially (as best shown in FIG. 1) in the clockwise direction toward the side of the drum on which the fabric F tends to accumulate as a result of the rotation and fabric movement caused by the ribs 74. This forces the incoming drying air to be directed upwardly through the major body of the fabric pieces F as shown in FIGS. 1 and 8. At the top of the shell 26 the restrictor plate 84 covers the axial central portion of opening 80 leaving circumferentially extending slots 30*a* on either side of the plates 84 and a full width opening 30*b* at one end thereby forming the upper opening 30 previously mentioned which is of a "U" shape. As shown in the side view FIG. 8, the drying air enters the bottom axial center of the drum 20 but in passing upwardly the air must progress laterally in each axial direction to reach the openings 30*a* which it has been found tends to cause the fabric F to float axially toward each end of the drum to produce a highly desirable tumbling and separating of the pieces of fabric. Further, as previously described with respect to FIG. 1, the proportion of drying air that passes through the opening 30*b* circumferentially located on the side of the drum to which the fabric pieces migrate due to rotation subjects the fabric pieces in the center of the drum to a thorough drying action as well.

Referring to FIGS. 10 and 11, an alternate embodiment of the outlet air opening from the drum is illustrated and designated generally as 130, corresponding to opening 30 previously described. In this embodiment, the inlet opening 28 may be the same as previously described and formed by the restrictor plate 86. However, at the upper portion of the shell 26 the opening 180 is much wider and in fact extends to the location of the tracks 76. In turn, the restrictor plate 184 is wider to produce circumferentially extending portions 130*a* located adjacent the tapered ends 72 of the drum. The end opening portion 130*b* is substantially similar but wider than the end opening portion 30*b* previously described. In this alternate embodiment, the path of air flow is forced axially further outwardly toward the ends of the drum to produce an even greater degree of axial movement of the fabric pieces away from the center of the drum by the air flow.

Figure 12:
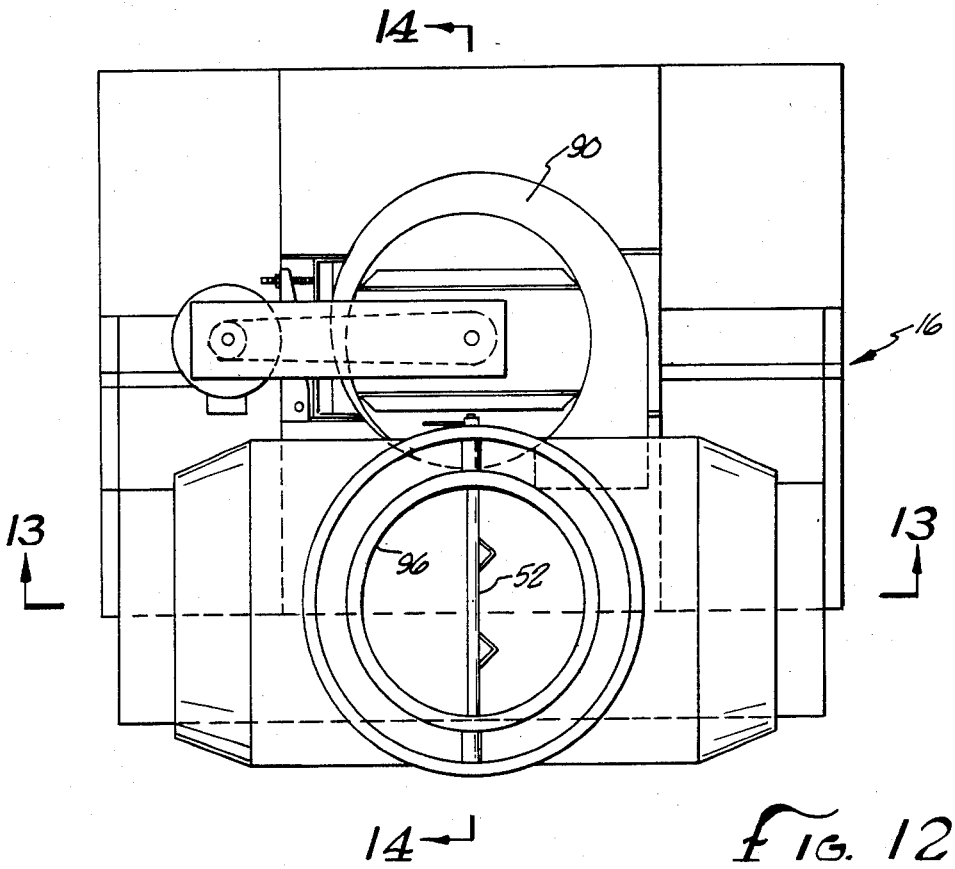
FIG. 12 is a top plan view of the air handling section of the tumbler dryer of this invention.
Figure 13:
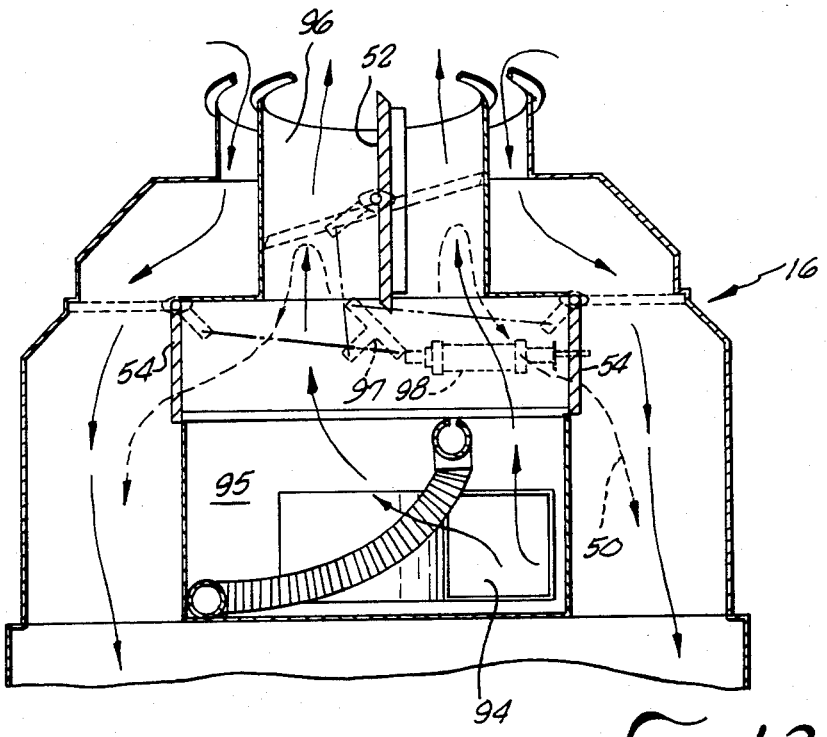
FIG. 13 is a front sectional view of the air handling section of the tumbler dryer taken substantially on lines 13—13 in FIG. 12 and illustrating the damper and lint removal arrangements.

Referring now to FIGS. 12, 13 and 14, the air handling section 16 is shown in greater detail. A blower 90 is mounted on top of housing 91 with a central opening 92 communicating with the duct 93 positioned on top of the cylindrical shell 26 for communicating the outlet opening 30 with the blower 90 for drawing the drying air upwardly through the tumbler. The air is discharged through an opening 94 into a plenum 95 upwardly through the lint removal apparatus 58 to the discharge duct 96 which contains the damper 52. The inlet dampers 54 are pivotally mounted on the plenum 95 to either close the sides thereof, as shown by cross-hatching in FIG. 13, for open loop (single path) air circulation or to open the sides of the plenum 95, as shown by dashed lines in FIG. 13, to provide recirculation as shown by dashed arrows 50. Each of the dampers 52 and 54 is provided with a crank arm which is connected by a rod to a pivotally mounted T-bar 97 that is pivoted by an actuator 98 to simultaneously move the three dampers between the two positions.

Referring to FIGS. 15, 16 and 17, the lint removal apparatus 58 is illustrated. A rectangular screen assembly 99 is adapted to be slidably received in the plenum 95 in a horizontal orientation to extend across the entire vertical opening in the plenum 95. A pipe or manifold 100 is positioned immediately below the screen 99 and extends across the shorter dimension thereof. The manifold 100 is supported on rails 101 and an actuator 102 is provided for causing the manifold to travel the full width of the plenum 95 periodically during the operation of the dryer. The manifold 100 is provided with a continuous slot 103 along the top thereof facing the screen 99. A suction hose 104 is connected to the manifold 100 and in turn to an exhaust blower and filter bag (not shown) for continually sucking the accumulated lint from the bottom of the screen 99 and disposing of same. The screen 99 can be removed periodically for inspection and cleaning of any lint not removed by the vacuum manifold 100.

Figure 18:
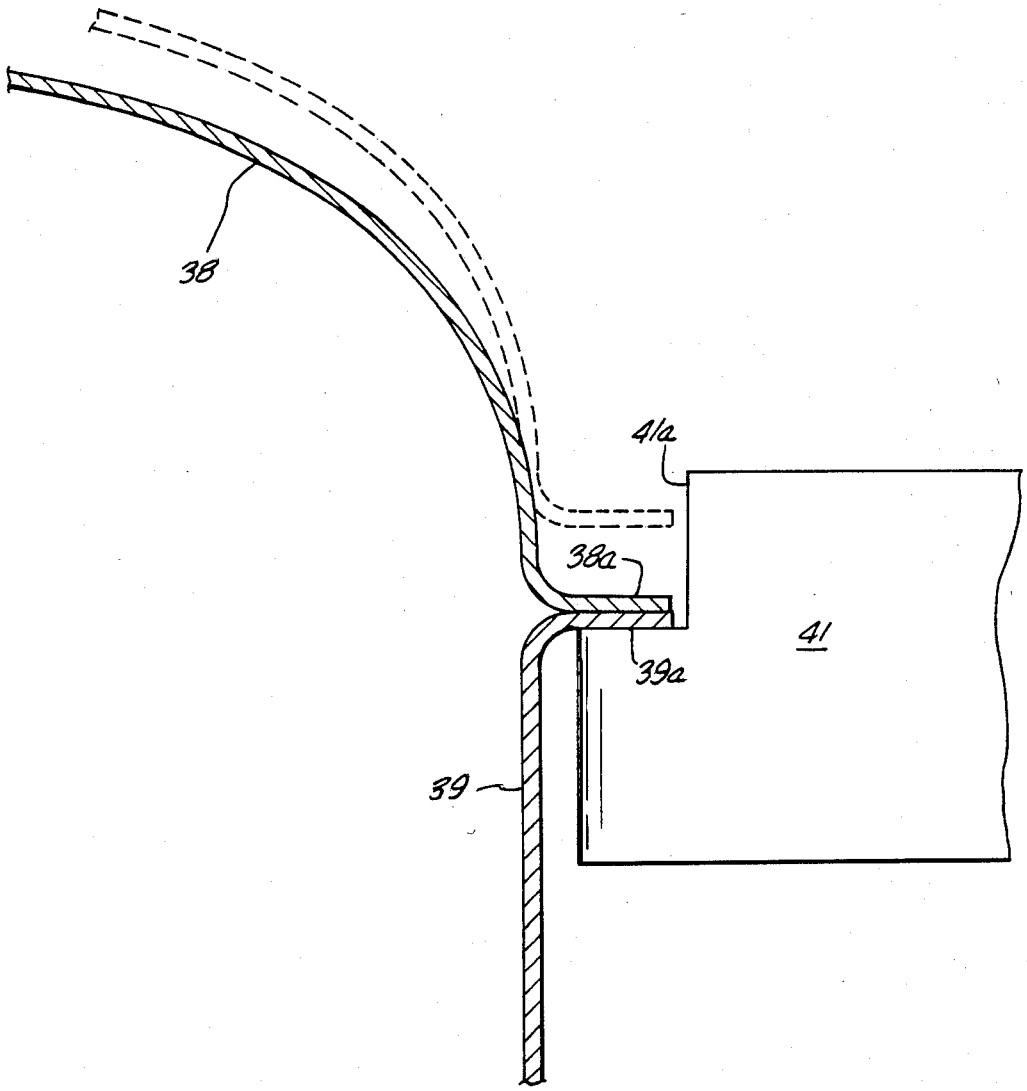
FIG. 18 is an enlarged sectional view of a portion of the burner flame deflecting arrangement of this invention.

Referring now to FIG. 18, an enlarged sectional view of a portion of the heat shield arrangement 38 previously mentioned as illustrated in further detail. Specifically, the heat shield comprises a dome shaped member 30 that is preferably impervious and capable of withstanding extreme heat, such as stainless steel sheet material, to deflect the entire flame discharge from the burner 34 outwardly and downwardly by reason of its domed shape. However, as an alternative, the dome heat shield 38 may be perforated or even constructed of a fine wire mesh to allow some of the products of combustion from the burner 36 to pass directly therethrough but without allowing any significant degree of flame to extend upwardly from the domed heat shield 38, which flame might undesirably scorch the the fabric in the drum. The periphery of the dome shaped heat shield 38 is provided with a flange 38*a*. A cylindrical heat shield or skirt 39 extends downwardly from the dome shaped shield 38 as a virtual extension thereof and is provided with a similar, outwardly extending flange 39*a*. A plurality of supporting brackets 41, such as four spaced at 90 degrees from each other, extend inwardly from a wall of the heater section 12 to support the heat shields 38 and 39 in a central location above the burner 34. Each bracket 41 is provided with an upwardly and inwardly facing notched portion 41*a* for receiving the flanges 38*a* and 39*a* to loosely support the heat shields as shown in FIG. 18. This support arrangement allows the dome shaped heat shield 38 to lift slightly, as shown in dashed lines, as a result of any pressure or flow surges by the burner 34 and permit the temporary surge to exhaust outwardly between the flanges 38*a* and 39*a* of the heat shields. The heat shields 38 and 39 also form the necessary secondary combustion zone for the burner 34 to accomplish complete combustion of the fuel before combining with the main flow of drying air passing upwardly through the drum.

Although this invention has been described in connection with a specific embodiment and certain alternate embodiments together with specific details of the various components thereof, it is to be understood that the invention is not limited to such embodiments or details but rather is a full scope of the appended claims.

I claim:

1. In a fabric dryer, the combination of; a housing, a perforated drum for the fabric mounted in the housing for rotation on a generally horizontal axis during drying, said housing having means cooperating with said drum for causing the drying air to circulate through said drum from only the central lower portion of the drum in an upwardly direction and at least partially in both axially outward directions to exit from the drum near the axial ends through circumferentially extending slots at each end with no air circulating passage located axially between said slots.

2. In a fabric dryer, the combination of; a housing, a perforated drum for the fabric mounted in the housing for rotation on a generally horizontal axis during drying, said housing having means cooperating with said drum for causing the drying air to circulate upwardly through said drum from the lower portion to the upper portion of the drum, said means including a cylindrical shell encircling the drum and having lower and upper openings for the drying air, the lower opening being located centrally in the axial direction and circumferentially off-center from the bottom in the direction of drum rotation.

3. In a fabric dryer, the combination of; a housing, a perforated drum for the fabric mounted in the housing for rotation on a generally horizontal axis during drying, said housing having means cooperating with said drum for causing the drying air to circulate upwardly through said drum from the lower portion to the upper portion of the drum, said means including a cylindrical shell encircling said drum and having lower and upper openings for the drying air to enter and exit the drum, the upper opening being generally "U"-shaped in plan view with the base of the "U" extending axial and located circumferentially off-center from the top in the direction opposite the drum rotation and the two arms of the "U" extending from the base portion in the direction of the drum rotation.

4. The fabric dryer of claim 3 in which the lower opening is located centrally in the axial direction and circumferentially off-center in the direction of drum rotation.

5. The fabric dryer of claim 4 in which said openings in the shell are formed by oversized openings in the shell each covered in part by a removable restrictor plate.

6. In a fabric dryer, the combination of; a housing, a perforated drum for the fabric mounted in the housing for rotation on a generally horizontal axis during drying, said drum having a central cylindrical portion of substantial length and short inwardly tapered portions on each end, said housing having means cooperating with said drum for causing the drying air to circulate through said drum from the lower portion of the drum only from an axially centered location in the cylindrical portion then in an upwardly direction and at least a substantial portion in both axially outward directions to exit from the tapered portions of the drum near the axial ends with no air circulating passage located axial between the said air exits through the tapered portions.

7. In a fabric dryer, the combination of; a housing, a perforated drum for the fabric mounted in the housing for rotation on a generally horizontal axis during drying, a fuel-fired burner mounted in the housing below the drum with the flame discharge thereof directed upwardly in a predetermined shape, a flame deflecting means mounted in the housing between said burner and drum and having a shape generally corresponding to said flame shape to symmetrically deflect the flame outwardly and downwardly, and said housing having passage means for conducting the air heated by said burner upwardly around the entire said flame deflecting means into the bottom of the drum and upwardly through the drum and out the top of the drum.

8. In a fabric dryer, the combination of; a housing; a perforated drum for the fabric mounted in the housing for rotation on a generally horizontal axis during drying, a fuel-fired burner mounted in the housing below and closely spaced from the drum with the flame discharge thereof directed upwardly, a flame deflecting means mounted in the housing between said burner and drum and including a dome-shaped member axially aligned with and directly above said burner and a cylindrical member extending downwardly from the dome member, said dome member supported on said cylindrical member in a manner to allow upward movement of said dome member upon a surge of combustion products from the burner to allow such combustion products to escape between said dome and cylindrical members, and said housing having passage means for conducting the air heated by said burner upwardly from around said flame deflecting means into the bottom of the drum upwardly through the drum and out the top of the drum.

9. The fabric dryer of claim 8 wherein said dome and cylindrical members have matching flanges extending outwardly, and brackets are mounted in said housing for supporting said flanges.

10. In a fabric dryer having a housing with a rotatable drum for the fabric and passageways for conducting heated air through the drum for drying the fabric, the improvement comprising; a lint collecting screen removably mounted in said housing in the passageway conducting the air exiting from the drum, a manifold mounted in said housing adjacent to and on the lint collecting side of said screen, said manifold extending across screen and having opening means facing said screen, means for moving said manifold to cause said opening means to be juxtaposed to substantially all portions of said lint collecting side of said screen, and vacuum means connected to said manifold for drawing the lint from said screen through said opening means and out of the manifold.

11. The fabric dryer of claim 10 wherein the lint screen is rectangular and the manifold extends across the shorter dimension of the screen, and said manifold moving means includes means for causing the manifold to reciprocate in the longer dimension of the screen.

12. The fabric dryer of claim 10 wherein said manifold opening means is comprised of a continuous slot extending the length of the manifold.

13. In a fabric dryer having a housing with a rotatable perforated drum for the fabric and passageways for conducting heated air through the drum to dry the fabric, the improvement comprising; said drum having a cylindrical central portion and tapered axial ends, circular track means mounted on said tapered ends of an outside diameter substantially equal to said cylindrical central portion, rollers mounted in said housing and engaging said track means for rotatably supporting said drum, said housing having a cylindrical shell surrounding and concentric with said drum without means sealingly engaging said drum, said shell extending the full length of said drum to said track means, said shell having inlet and outlet openings therein at spaced locations and communicating with the housing passageways for conducting the heated air into and through the drum through the perforate walls thereof, and said shell being of an inside diameter only slightly greater than said outside diameter of said drum for minimizing the quantity of heated air from the inlet opening that passes around the outside of the drum and inside said shell to the outlet opening without passing through the drum for drying the fabric.

14. In a fabric dryer having a housing, a rotatable perforated drum for the fabric, a burner for heating the drying air, passageways for conducting the drying air to and from the drum, and a fan for causing the drying air circulation, the improvement comprising; said drum being of substantially the same horizontal length and width as the housing for obtaining the maximum drum size and capacity for the floor space occupied by the housing, said passageways arranged to pass the heated drying air vertically upwardly through the drum and recirculating that air downwardly along the sides of the drum for reheating, and said burner, fan and all other dryer components mounted in said housing above or below the drum.

15. In a fabric dryer, the combination of, a housing, a rotatable perforated drum for the fabric, a burner for heating the drying air, passageways for conducting the drying air to and from the drum, a blower for causing the drying air circulation, said drum being of substantially the same horizontal length and width as the housing for obtaining the maximum drum size and capacity for the floor space occupied by the housing, said burner positioned below said drum, said blower positioned above said drum, and said passageways arranged to conduct the drying air downwardly past the exterior of the cylindrical sides of said drum to the burner and then vertically upward through the drum to the blower.

16. The fabric dryer of claim 15 wherein an air handling section having said blower is provided above said drum and includes damper means in association with said passageways for selectively recirculating the drying air exiting upwardly from said drum to pass downwardly again past the exterior of said drum to the burner or to exhaust such drying air.

17. The fabric dryer of claim 16 wherein said damper means also prevent the intake of fresh air in said recycling mode.

18. The fabric dryer of claim 15 wherein an air handling section having said blower is provided above said drum and includes a lint removal apparatus for filtering the air exiting from the drum.

19. The fabric dryer of claim 18 wherein said lint removal apparatus includes a lint collecting screen removably mounted in said air handling section in the passageway conducting the air exiting from the drum, a manifold mounted in said housing adjacent to and on the lint collecting side of said screen, said manifold extending across screen and having opening means facing said screen, means for moving said manifold to cause said opening means to be juxtaposed to substantially all portions of said lint collecting side of said screen, and vacuum means connected to said manifold for drawing the lint from said screen through said opening means and out of the manifold.

20. In a fabric dryer, the combination of; a housing, a perforated drum for the fabric mounted in the housing for rotation on a generally horizontal axis during drying, said drum having substantially the same horizontal length and width as said housing, a fuel-fired burner mounted in the housing below the drum with the flame discharge thereof directed upwardly, a flame deflecting means mounted in the housing between said burner and drum and shaped to deflect the entire flame outwardly and downwardly, said housing having passage means for conducting the air heated by said burner upwardly around the entire said flame detection means into the bottom of the drum upwardly through the drum and out the top of the drum including a cylindrical shell surrounding and closely spaced from said drum with openings in the lower and upper portions of the shell for the passage of drying air therethrough, said shell openings of a size and shape to cause the drying air to enter the axially central portion on the bottom and exit axially spaced locations near the drum ends on the top, an air handling section positioned above the drum and having a blower for causing drying air circulation downwardly along the exterior of the drum to the burner then upwardly through the drum, said air handling section including lint removal means position to filter the air exiting the drum, and damper means in said air handling section to selectively cause drying air recirculation or open loop circulation.

21. The fabric dryer of claim 3 in which a fuel-fired burner is mounted in the housing below said drum with the flame discharge thereof directed upwardly in a predetermined shape, a flame deflecting means is mounted in said housing between said burner and drum and has a shape generally corresponding to said flame shape to symmetrically deflect the flame outwardly and downwardly, and said housing including passage means for conducting the air heated by said burner upwardly around the entire said flame deflecting means into the bottom of said drum.

22. The fabric dryer of claim 21 in which said flame deflecting means includes a dome-shaped member aligned with and directly above said burner and a cylindrical member extending downwardly from said dome-shaped member, and said dome-shaped member is supported on said cylindrical member in a manner to allow upward movement of said dome-shaped member upon a surge of combustion products from said burner to allow such combustion products to escape between said dome-shaped member and said cylindrical member.

23. The fabric dryer of claim 8 in which said housing passage means includes a cylindrical shell encircling said drum and having lower and upper openings for the drying air to enter and exit the drum, and said upper opening being generally "U"-shaped in plan view with the base of the "U" extending axially and located circumferentially off-center from the top of the drum in the direction opposite to the drum rotation and the two arms of the "U" extending from the base portion in the direction of the drum rotation.

24. The fabric dryer of claim 16 wherein said damper means includes two dampers openable in opposite lateral directions relative to said drum for directing the recirculating drying air to the two opposite cylindrical sides of said drum exterior.

* * * * *